United States Patent [19]

Aryus et al.

[11] 3,953,151

[45] Apr. 27, 1976

[54] AGITATOR FLOTATION CELL FOR THE PREPARATION OF MINERALS AND COALS

[75] Inventors: Arnold Leo Aryus, Porz; Friedel Isenhardt, Forsbach; Bruno Schmitz, Cologne-Holweide, all of Germany

[73] Assignee: Klockner-Humboldt-Deutz Aktiengesellschaft, Germany

[22] Filed: Jan. 28, 1975

[21] Appl. No.: 544,920

[52] U.S. Cl. ..... 416/183; 416/184; 209/169; 261/93

[51] Int. Cl.[2] ..... F04D 29/18

[58] Field of Search ..... 209/169; 210/44, 221; 261/87, 93; 416/184, 185, 188, 183; 259/7, 8, 23, 24, 43, 44, 107, 108

[56] References Cited

UNITED STATES PATENTS

| | | | |
|---|---|---|---|
| 2,243,309 | 5/1941 | Daman et al. | 209/169 X |
| 2,871,000 | 1/1959 | Dowling | 259/8 X |
| 3,420,370 | 1/1969 | Isenhardt et al. | 209/169 |
| 3,679,323 | 7/1972 | Buck | 416/184 X |
| 3,843,101 | 10/1974 | Green | 259/107 X |

FOREIGN PATENTS OR APPLICATIONS

| | | | |
|---|---|---|---|
| 1,356,625 | 2/1964 | France | 259/108 |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

An agitation flotation cell for the preparation of minerals and coals having at its lower end a structure including a vertical shaft with a disk at the lower end of the shaft being circular in plan view with said disk having a first lateral section tapering outwardly and downwardly from a central diametral line passing through the shaft and a disk having a second lateral section tapering outwardly and downwardly from the central diametral line with the two sections meeting at a peak to form a roof-shaped surface with first and second radially extending vanes projecting above the first and second sections extending at right angles to the peak and third and fourth radial vanes extending downwardly from the peak on the bottom side of the vanes and being parallel to the peak.

5 Claims, 2 Drawing Figures

Figure 1:
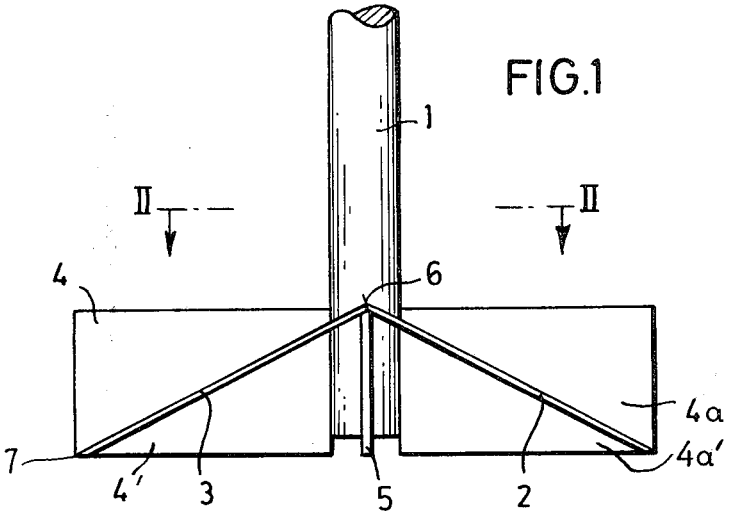

1
II
II
4
6
4a
7
4'
3
5
2
4a'

6
7

5a
3
2
1
4
4a
5

AGITATOR FLOTATION CELL FOR THE PREPARATION OF MINERALS AND COALS

BACKGROUND OF THE INVENTION

The invention relates to an agitation flotation cell for the preparation of minerals and coals having a vertical agitation shaft with a circular disk at the bottom at right angles to the shaft. The shaft and lower end thereof is particularly used in a floatation cell such as that shown in German Pat. No. 1,164,946, or U.S. Pat. No. 3,256,987, Isenhardt et al, which are incorporated by reference herein in their entirety. In such an arrangement, the upper side of the disk is exposed to a connection with an air intake pipe.

With this construction of the agitator, sludge is sucked up mixed with air and centrifuged off in an outward direction. The direction of the sludge airstream at the circumference of the disk is constantly altered because of the inclined position during rotation. Because of this construction, good turbulence or swirling motion of the air and sludge in the cell takes place.

Inasmuch as the swirling motion of the air and sludge in the cell is dependent upon the inclination of the disk, this may be predetermined in accordance with the cell design and need not be altered. Newer space flotation cells require agitators for a disk with relatively large diameters and require substantial structural heights of the agitator.

In order to lower the structural height of the agitator and attain a better turbulence than with agitator flotation cells heretofore available, the present invention employs radial vanes with disk sections therebetween at angles to each other and to a plane at right angles to the agitator shaft. In a preferred embodiment, two lateral sections which join at a peak to form a roof-shaped upwardly facing surface at one side of the shaft with two similar sections at the other side of the shaft. With the construction as shown and described in accordance with the invention when used with large flotation cells, a substantial increase in degree of efficiency is attained. With small flotation cells, the structural height of the agitator is lowered. A further advantage of the invention is that the uniquely shaped disk is provided, at least on the upper surface with radial vanes or ribs which extend upwardly from the upper planar surface of the disk. With this construction and the decrease of the structural height of the agitator, an improvement in the turbulence of air and sludge is attained in the cell.

It is accordingly an object of the present invention to provide an agitator flotation cell of improved construction which operates with increased efficiency and effectiveness and which further reduces the vertical dimensions necessary.

Other objects, advantages and features, as well as equivalent structures which are intended to be covered herein, will become more apparent with the teachings of the principles of the invention in connection with the disclosure of the preferred embodiment in the specification, claims and drawings, in which:

DRAWINGS

Figure 2:
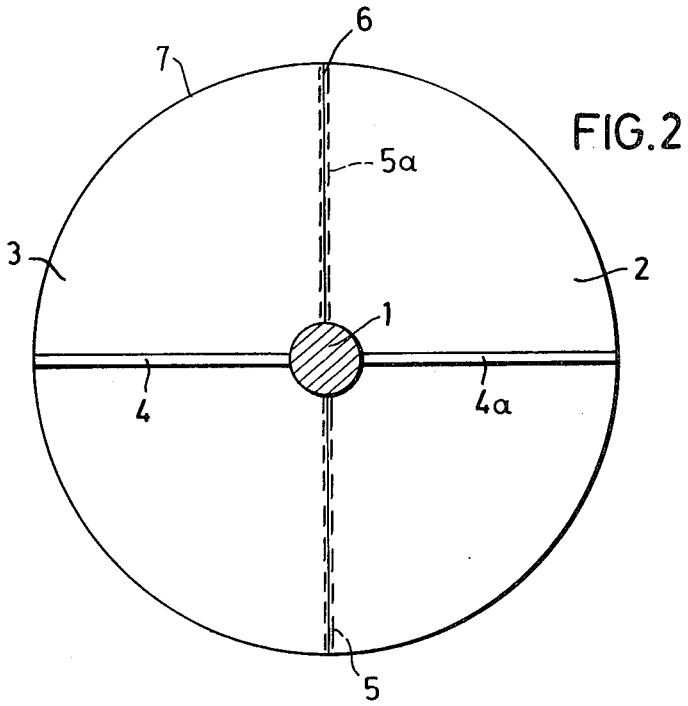

FIG. 1 is a front elevational view of an agitator constructed in accordance with the principles of the invention; and FIG. 2 is a vertical sectional line taken substantially along line II—II of FIG. 1.

DESCRIPTION

As illustrated in FIGS. 1 and 2, the agitator portion includes a vertical shaft 1. At the lower end of the vertical shaft and attached thereto are first and second lateral sections or plates 2 and 3 which are secured to each other along a diametral line 6 intersecting the shaft and forming a peak. The lateral sections are preferably formed of flat sheet material and have upper planar surfaces which taper downwardly in a radial outward direction from the peak 6. The outer edge 7 of the sections which form the disk is circular in plan view as illustated in FIG. 2. Inasmuch as the lateral sections of the disk are formed of flat material, their lower surfaces present downwardly facing planar surfaces.

The disk assembly includes at least one radially extending vertical vane or rib, and preferably vanes which extend the height of the roof-shaped disk and which bisect the disk and extend at right angles to the peak 6. The vanes extend transversely through the disk sections so that they may be considered as including a first vane 4 and a second vane 4*a* with these vanes being at right angles to the roof peak 6. The vane 4 is at right angles to the disk section 3 and has an upper portion 4 which extends above the section 3, and a lower portion 4′ which extends below the section 3. Similarly, the vane 4a has an upper portion which extends above the lateral disk section 2, and a lower portion 4*a*′ which extends below the lateral disk section 2.

Parallel to the peak 6 and below the disk sections are vanes 5 and 5*a*. Each of the vanes is substantially the height of the tapered lateral disk sections. The vanes preferably are made of flat material so that they present planar circumferentially facing surfaces. The vanes are also of a length so that their outer edges are vertical and are coincident with the circumferential outer edge 7 of the disk. Their upper and lower edges are horizontal. Their inner edges are secured to the shaft 1 such as by welding. The vanes 4 and 4*a* may be made of one piece and bisect the lateral disk sections which may be made in two separate pieces, or conversely, the lateral disk sections 2 and 3 may each be made in one piece with the vanes 4 and 4*a* made in two pieces with one piece secured above the disk and the other piece secured below. This may be accomplished by attaching the vanes with a weld bead to the disk, or the entire unit may be cast or otherwise fabricated by suitable manufacturing methods.

With the arrangement shown having two lateral disk sections 2 and 3 with bisecting vanes 4 and 4*a*, additional vanes 5 and 5*a* extending from the peak below the disk sections, the operation of the flotation cell is possible with a high air suction effect, and intensive turbulence of the air and sludge is obtained in the cell. The degree of efficiency and output yield is increased appreciably over presently used agitation flotation cells particularly those which are large. Further, a low structural height has been obtained.

We claim as our invention:

1. An agitator for use in an agitator floation unit for the preparation of minerals and coals having an agitation shaft with an air supply pipe opening at the lower end of the shaft, comprising:

a vertical shaft;

a disk at the lower end of the shaft having two planar semicircular plates meeting at a radial ridge intersecting the shaft at a right angle thereto with the planar portion of each of the plates depending downwardly and outwardly from the ridge;

first radial vanes fixed to the lower side of the ridge and extending in an axial direction at each side of the shaft;

and second radial vanes each substantially bisecting one of the semicircular plates and extending above the plates with each of said first and second vanes parallel to the shaft axis and extending axially substantially the height of the disk in an axial direction.

2. An agitator for use in an agitator flotation unit for the preparation of minerals and coals having an agitation shaft with an air supply pipe opening at the lower end of the shaft, in accordance with claim 1:

wherein said vanes are of equal radial length and equal axial height.

3. An agitator for use in an agitator flotation unit for the preparation of minerals and coals having an agitation shaft with an air supply pipe opening at the lower end of the shaft, constructed in accordance with claim 1:

wherein said vanes are formed of flat thin material presenting circumferentially facing planar surfaces.

4. An agitator for use in an agitator flotation unit for the preparation of minerals and coals having an agitation shaft with an air supply pipe opening at the lower end of the shaft, constructed in accordance with claim 5:

wherein said vanes have vertical edges at their radial outward ends forming edges parallel to the axis of the sahft.

5. An agitator for use in an agitator flotation unit for the preparation of minerals and coals having an agitation shaft with an air supply pipe opening at the lower end of the shaft, constructed in accordance with claim 1:

wherein the vanes are secured at their radial inner ends to the shaft.

* * * * *